US006824027B2

(12) United States Patent
Frey

(10) Patent No.: US 6,824,027 B2
(45) Date of Patent: Nov. 30, 2004

(54) CAP BRIM SHAPER

(76) Inventor: Frank R. Frey, 437 Forty-Niner Dr., Fruita, CO (US) 81521

( * ) Notice: Subject to any disclaimer, the term of this patent is extended or adjusted under 35 U.S.C. 154(b) by 191 days.

(21) Appl. No.: 10/251,207

(22) Filed: Sep. 19, 2002

(65) Prior Publication Data

US 2003/0226861 A1 Dec. 11, 2003

Related U.S. Application Data

(60) Provisional application No. 60/387,048, filed on Jun. 7, 2002.

(51) Int. Cl.[7] ..... A42C 1/04

(52) U.S. Cl. ..... 223/14; 223/84; D2/891

(58) Field of Search ..... 223/14, 84; 211/30, 211/31, 32, 33; D2/891, 892

(56) References Cited

U.S. PATENT DOCUMENTS

| | | | |
|---|---|---|---|
| 3,737,081 | A | 6/1973 | James |
| 5,038,941 | A | 8/1991 | Bastiaansen |
| 5,137,157 | A | 8/1992 | Lawson |
| 5,244,102 | A | 9/1993 | Koenig |
| 5,480,073 | A | 1/1996 | LaManna |
| 5,533,652 | A | 7/1996 | Levin |
| D379,860 | S | 6/1997 | Levin |
| 5,685,465 | A | 11/1997 | Berardis |
| 5,727,694 | A | 3/1998 | Larson |
| 5,758,779 | A | 6/1998 | Atkins |
| 5,908,146 | A | 6/1999 | Levin |
| 5,991,927 | A | 11/1999 | Barbaccia |
| 6,125,997 | A | 10/2000 | Campbell |
| 6,293,413 | B1 | 9/2001 | Patton |
| 6,311,879 | B1 | 11/2001 | Rigler et al. |
| 6,315,175 | B1 | 11/2001 | Berger |
| D455,892 | S | 4/2002 | Crawford |
| 6,422,400 | B1 | 7/2002 | Miller |
| 6,422,401 | B1 | 7/2002 | Roten |

OTHER PUBLICATIONS

Softball Sales, First in Softball, Spring II 2002, p. 43.

*Primary Examiner*—John J. Calvert
*Assistant Examiner*—James G Smith
(74) *Attorney, Agent, or Firm*—Oppedahl & Larson LLP

(57) ABSTRACT

The present invention provides a cap brim shaper for shaping the brim of a sports cap comprising a body member with at least two grooves. Both grooves are sufficiently long and wide to receive the brim of a sports cap. The second groove's curvature is greater than the first groove's curvature and the second groove is nested within the first groove. This shaper may be incorporated into a variety of systems for transporting or storing one or more caps while shaping the brim(s). These systems include supports which may be flat boards for mounting, boxes, or display cases.

26 Claims, 6 Drawing Sheets

Comment: Stackable

CAP BRIM SHAPER

This application claims the benefit of U.S. Provisional Application Ser. No. 60/387,048, filed Jun. 7, 2002, which is incorporated herein by reference.

BACKGROUND OF THE INVENTION

This application relates to an apparatus utilized for shaping the brim of a sports cap. The apparatus yields consistent curves for cap brims and may be further incorporated into a display, storage, or transporting apparatus for one or more caps.

It has become popular for baseball players as well as others who wear sports caps to shape the brim of the cap so that it curves downward. The curve may be made by simply bending the cap with ones hands. However, this often does not result in consistent or symmetrical bends, ergo the cap may be over curved, under curved, or lopsided. An additional problem is that once an acceptable curve is made in the cap brim, it may be difficult to maintain it. This is especially true if care is not taken when the cap is stored or transported.

A variety of different designs have been described to shape or store sports caps. Exemplary of these are the materials described in U.S. Pat. Nos. 6,311,879; 5,244,102; 5,685,465; 5,758,779; 5,480,073; 5,727,694; 5,991,927; 6,315,175; D455,892; 6,293,413; 6,125,997; 5,038,941; 5,137,157; 3,737,081. Notwithstanding these varied disclosures, there remains room for improvement towards a design that curves a cap brim as well as potentially maintaining the curve during storage, transport, or display.

SUMMARY OF THE INVENTION

The present invention provides a cap brim shaper for shaping the brim of a sports cap comprising a body member with at least two grooves. Both grooves are sufficiently long and high to receive the brim of a sports cap. The second groove's curvature is greater than the first groove's curvature and the second groove is suitably nested within the first groove. This shaper may be incorporated into a variety of systems for transporting or storing one or more caps while shaping the brim(s). These systems include supports which may be flat boards for mounting, boxes, or display cases.

DETAILED DESCRIPTION OF THE INVENTION

Figure 1A:
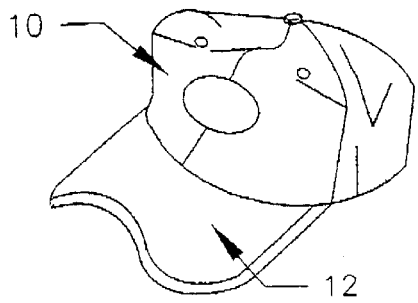
FIGS. 1A and B shows a sports cap and a visor 11 each having a brim.
Figure 1B:
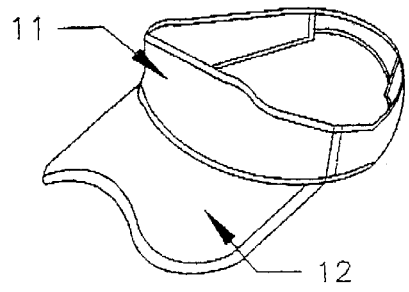

The present invention provides a cap brim shaper for use in the shaping the brim of a brimmed sports cap. As used in the specification and claims of this application, the term "brimmed sports cap" refers to a cap which has a head-encompassing portion and a brim. The brim extends from the head-encompassing portion along only a portion of the circumferential edge of the head-encompassing portion to provide a shade for the eyes. Common examples of brimmed sports caps include baseball caps (although of course any logo may be applied, not only that of a baseball team, or no logo at all) which are closed on the top, and visors which do not cover the top of the head. Examples of a closed-top sports cap 10 and a visor 11 are illustrated in FIGS. 1A and B, each type of brimmed sports hat having a brim 12.

The cap brim shaper of the invention comprises a body member having at least two grooves formed in a common surface thereof. The body member may be made out of any material that is sufficiently stiff for maintaining the shape of the grooves while shaping the cap brim. Non-limiting examples of suitable materials include wood, plastic, metal, plexiglass, glass, carbon composite.

The body member may be a single solid or a hollow piece, or it may be assembled from multiple solid or hollow pieces. In the later case, the pieces may be assembled with glue; fasteners such as screws, nuts, and bolts; or other acceptable means such as custom-made tongue and grooves. The body member as a single or multiple pieces may be created through extrusion, injection molding, casting, woodworking, or other acceptable methods. Preferred methods are those that make the body member consistently and cost effectively. The body member may be painted or dyed any color or remain the color of the material that it is made of.

The body member of the cap brim shaper of the invention has at least two grooves formed therein. Each of the grooves is sufficiently long and wide to receive a brim of a sports cap, however, the grooves differ in curvature such that the grooves can be nested together. As used in the specification and claims hereof, the term curvature refers to a concave curved shape (i.e, not a straight line) with a central plane of symmetry. Non-limiting examples of curved shapes include circular, elliptical, ovoid, rectangular with rounded corners, parabolic, and rounded V-shapes. As used in the specification and claims of this application, the term "nested" refers to the spatial relationship of the two or more grooves in the body member. The grooves are arranged such that the concave sides are oriented on the same sides, i.e., they fit generally one within the other. The grooves may suitably be arranged such that the plane of symmetry of all grooves formed in a body member are the same, but grooves are considered "nested" so long as the plane of symmetry of one groove passes through some part of the other grooves in the body member. Nested grooves in the cap brim shaper of the invention may be totally separate from one another, or they may share a common region over a portion of the length of the groove.

Each groove also has a length (or width), a height, and a depth which extends inwards from the front surface of the body member. The length is not critical, provided it is sufficient to receive the brim of a sports cap. However, the length is preferably closely matched to the brim-size as this makes it easier to fit the brim symmetrically within the groove. While there are some variations, the width of most caps measure about 7¼ inches, but may also range from 6½ to 9 inches. In general, this means that the grooves preferably have a length of 6⅝ to 9⅛ inches.

The height of the groove needs to be sufficient to allow insertion of the brim of a sports cap without damaging it. At the same time, too large a groove height will not provide adequate shaping and will not serve to hold the cap in position. Thus, it is preferable that the height of the groove be such that the brim is snugly engaged within the groove, for example about ⅛ to ⅜ of an inch.

The depth of the groove needs to be sufficient to receive the brim of sports cap and to retain it for holding and shaping purposes. In general, this is a depth of at least 1½ inches. A preferred depth is 5¼ inches. The groove need not have the same thickness throughout. For example, the groove may be thinner near the front surface of the shaper, than near the back. Further, as will be apparent from the increased height when a common region is shared among several grooves, the thickness of the groove can vary across the width of the groove. The groove may extend only part-way through the body member, or it may extend completely through the body member. The groove may be formed parallel to the top and/or bottom surfaces of the body member, or it may be formed at an angle with respect to the top and/or bottom surface of the body member. FIG. 11 illustrates a variety of these orientations. Each groove is symmetrical about a central plane of symmetry 24, and preferably this plane of symmetry may also be, and preferably is, the central plane of the body member.

Figure 2A:
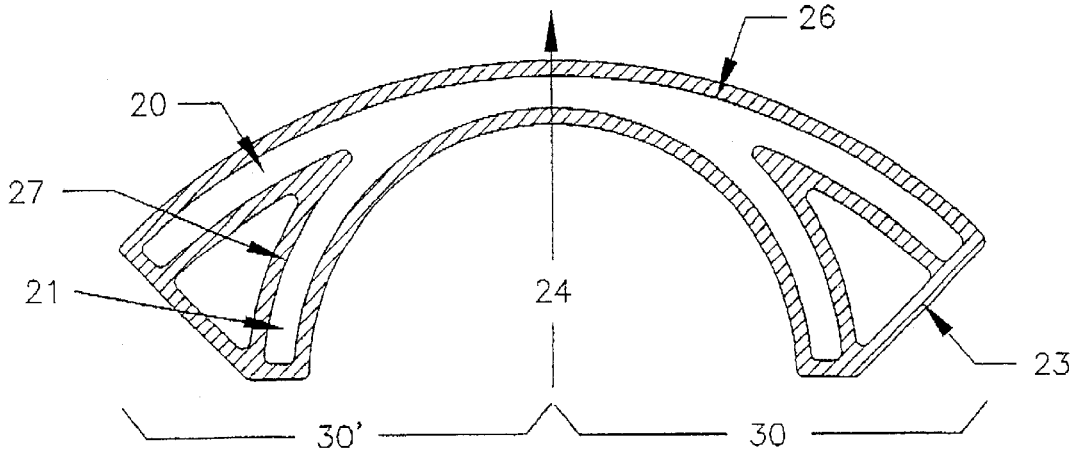
FIG. 2A is a front view of a two groove cap brim shaper in accordance with the invention.

FIG. 2A shows a first embodiment of a cap brim shaper of the invention. As shown in FIG. 2A, the cap brim shaper has a body member 23 with grooves 20 and 21 formed therein. Grooves 20 and 21 are nested, and have a shared central region 26. The body member 23 has a front side which is shown facing the viewer in FIG. 2A, and similar right and left portions 30, 30' separated by a central plane of symmetry along line 24. In an embodiment of the invention shown in FIG. 2A, the first groove 20 has a circular curvature. An exemplary radius of the first groove, as measured from the outer edge 26 of the curvature for groove 20, may range from 3 to 6 inches. In this embodiment of the invention, the second groove 21 also has a circular curvature. An exemplary radius of the second groove, measured from the outer edge 27 of the curvature for groove 21, may range from 1¼ to 3 inches.

Figure 2B:
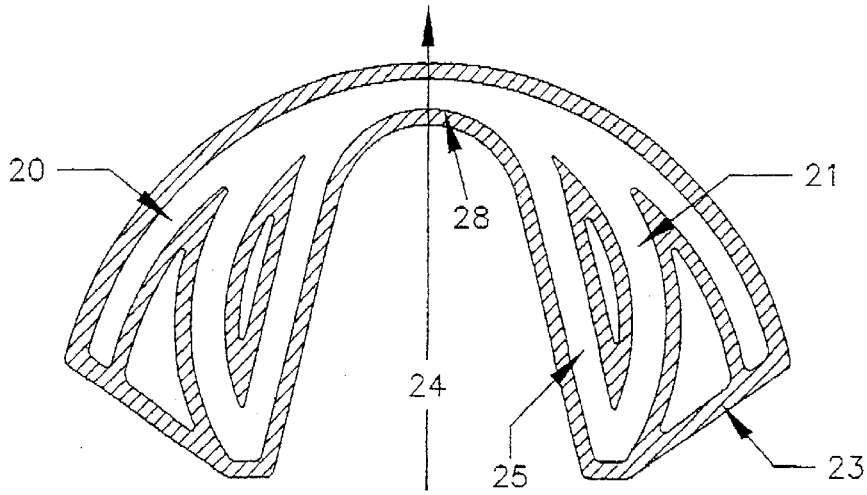
FIG. 2B is a front view of a three groove cap brim shaper in accordance with the invention.

FIG. 2B shows another embodiment of the cap brim shaper of the invention. As illustrated in FIG. 2B, a body member may contain three grooves. In the embodiment depicted, the first two grooves have circular curvatures like those described in the paragraph above. The third groove 25 has a rounded V-shaped groove. In general, if a groove is a V-shaped groove, then the groove has a top curvature with a radius ranging between ½ to 1¼ of an inch, measured from the inner edge of the curvature 28. Additional, non-limiting combinations for the grooves of a body member may include: two non-circular grooves; one circular and one non circular groove, such as a V-shaped or elliptical shaped groove; two non-circular grooves that are the same basic shape but with different radii, such as two different V-shapes; two non-circular grooves that are not the same shape; three non-circular grooves; three circular grooves; two circular and one non-circular; or two non-circular and one circular groove.

The overall exterior shape of the body member is not critical, provided it has sufficient size to surround the grooves, and may take on various aesthetic modifications. For example, as shown in FIG. 3, the ends of the body member may be contoured.

The present invention also provides a system for holding one or more caps while shaping the brims thereof. This system comprises a support and one or more cap brim shapers. The support as used in the specification and claims hereof, refers to a mechanism for supporting, mounting, or containing, one or more cap brim shapers.

Figure 3:
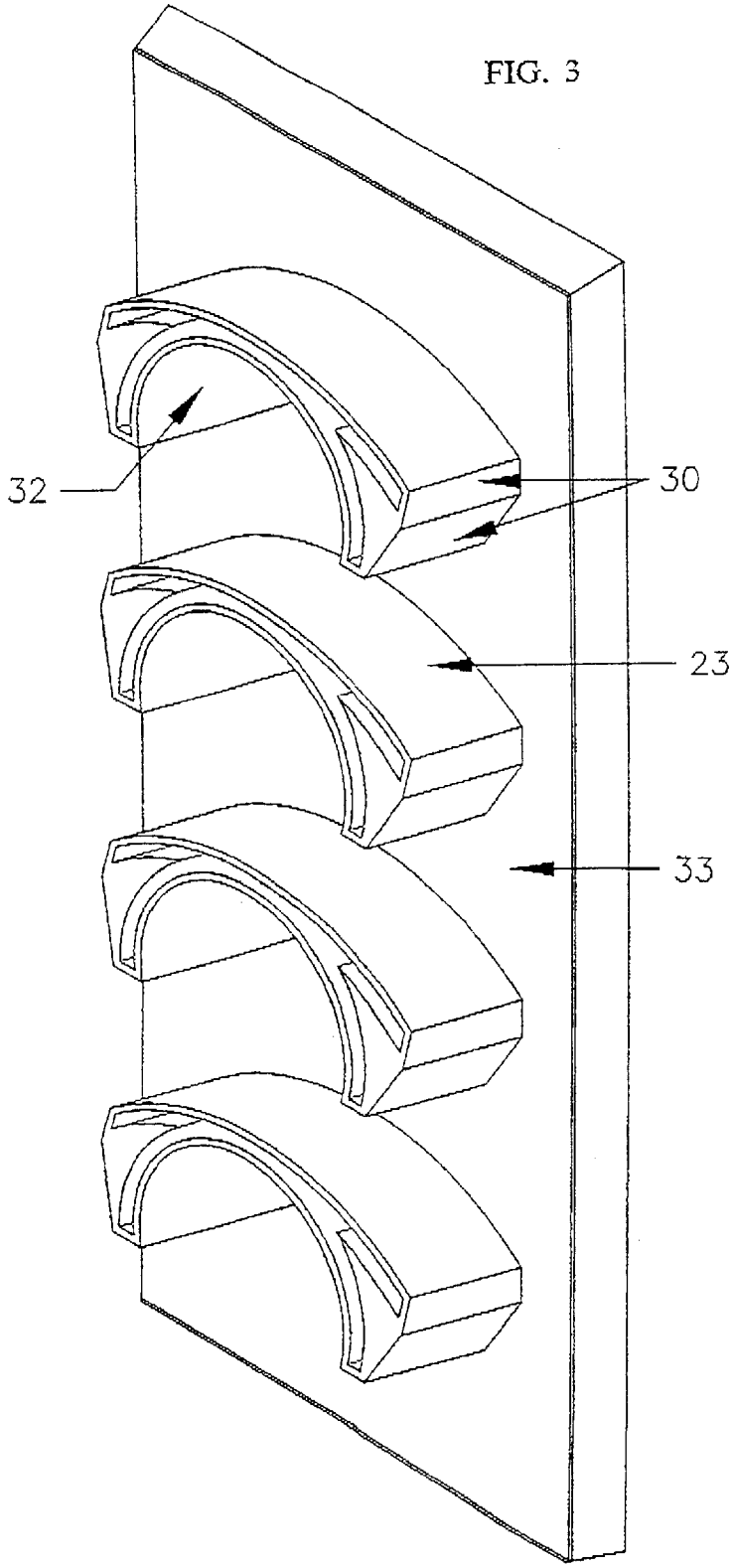
FIG. 3 is a perspective view of four cap brim shapers of the invention mounted on a backing board.

An embodiment of the system of the invention is illustrated in FIG. 3 where the support is a board 33 bearing multiple cap brim shapers 23. The board may be as wide as, or wider than, the cap shaper or may be narrower depending on the mounting application and aesthetic affect desired. The board 33 may be made of a variety of materials which include: wood, plastic, metal, plexiglass, glass, drywall, particle board, carbon composite, or any other material that is sufficiently strong to support at least one cap shaper. The board 33 may be a single solid or hollow piece, or may be assembled from multiple solid or hollow pieces. In the latter case, pieces may be assembled with glue; fasteners such as screws, nuts, and bolts; or other acceptable means such as custom made tongue and grooves. The board 33 or its pieces may be created through extrusion, injection molding, casting, woodworking, or other acceptable methods. Preferred methods are those which make the board consistently and cost effectively. The board 33 may be painted any color or may remain the color of its composition material. It is acceptable for the board 33 to be made out of the same material as the body member 23 of the shaper, but this is not necessary. It is also acceptable but unnecessary for the board 33 to be the same color as the body member of the shaper.

Figure 4:
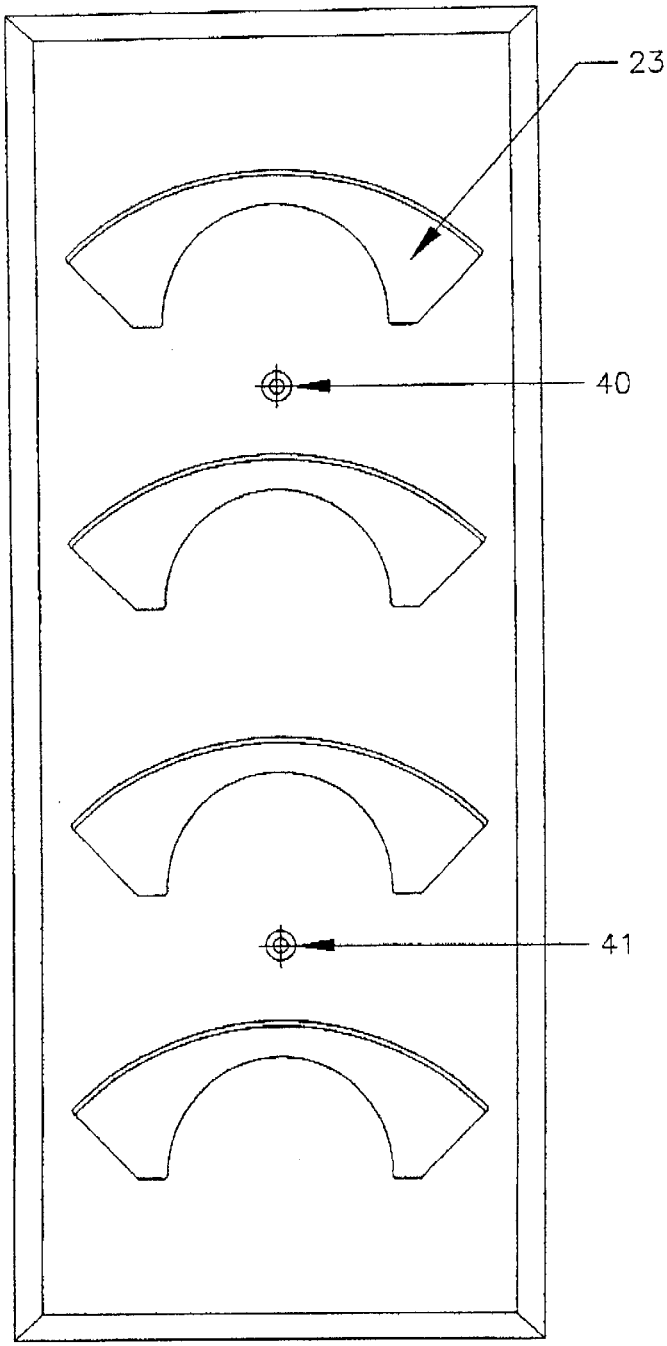
FIG. 4 is a front view of a system in accordance with the invention.

In a preferred embodiment of a system of the invention, board 33 has at least one mounting hole 40 or 41 (FIG. 4). While the board 33 may have mounting holes 40 and 41, other means for mounting may be used. Several examples include hammering a nail or tightening a screw through the board into a wall, providing a set of brackets for the back, providing double sided tape, or providing a screw and key hole mounting system.

An exemplary embodiment of the board is one in which the board has a flat surface that is at least ¾ of an inch thick. The purpose of the ¾ thickness is to allow a recess 51 (FIG. 5) to be created in the board so that the cap shaper can be mounted within the recess. Although this is a preferred embodiment, it is not necessary to have the ¾ inch thickness because the flat surface of the board 33 may also be mounted flush against the back surface of the cap shaper. The term "mounted" as used in this paragraph and the claims of this patent application with respect to the cap shaper and the board means attached by methods including but not limited to: gluing, hammering a nail, tightening a screw, taping, or other appropriate means that will allow the cap brim shaper to support itself against the board while containing the additional weight of a cap.

Figure 7:
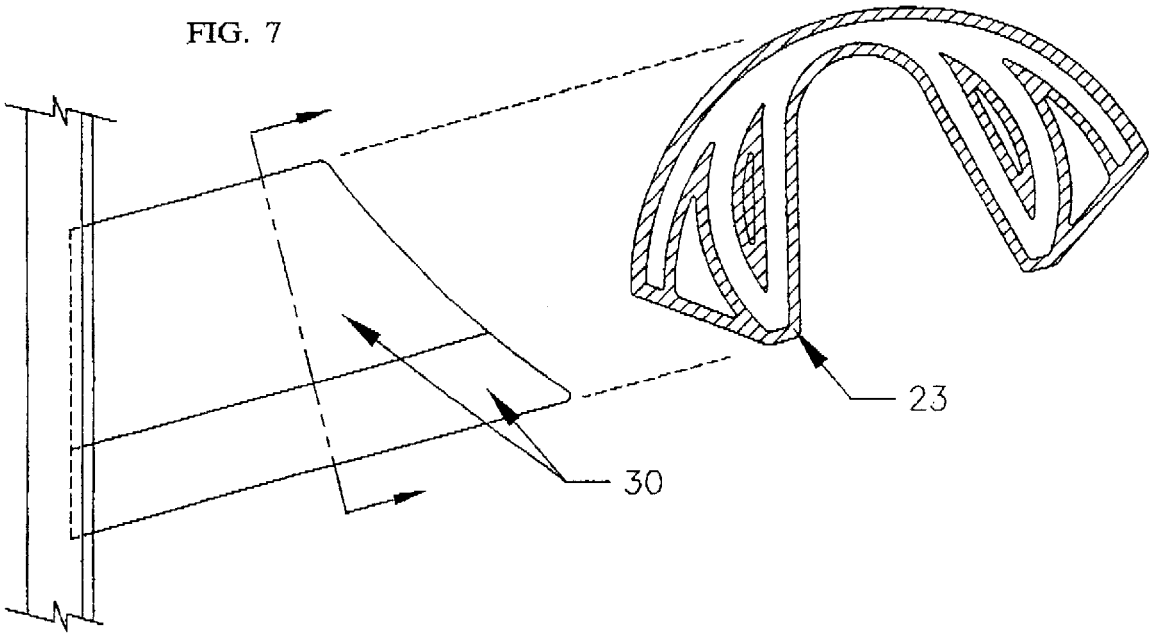
FIG. 7 is a side view showing an embodiment of the mounting of the cap shaper of the invention on a mounting board.
Figure 8:
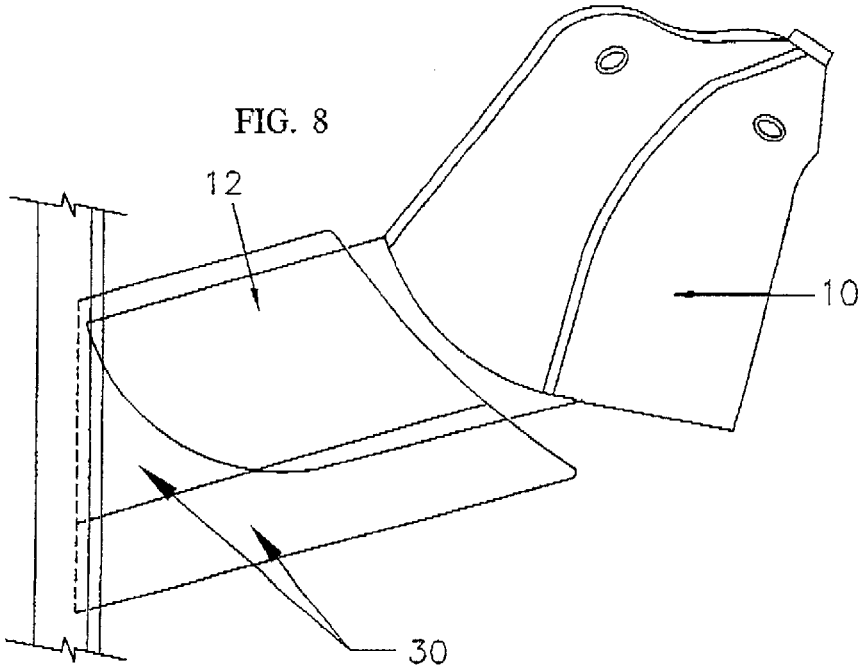
FIG. 8 is a side view of a cap shaper of the invention showing a cap brim inserted into the cap shaper.

If there is a recess in the board 33, it is preferred but not required to mount the cap shaper on the board at an angle as illustrated in FIG. 7. The figures shows a cap shaper of the invention inserted into the board 33 and at a sufficient angle to inhibit a cap placed into the shaper from falling out. A preferred angle is 105 degrees between the bottom of the body member 32 and board 33. Other acceptable angles may range from 90 to 105 degrees (See FIGS. 11A, B, C, and D). A shaper at the 105 degree angle is illustrated in FIG. 8 with a sports cap brim 12 inserted into it.

Figure 5:
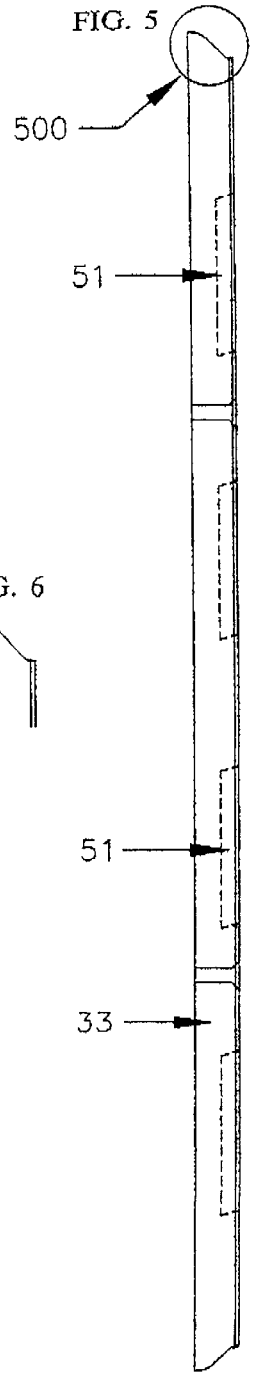
FIG. 5 is a side view of a mounting board useful in a system in accordance with the invention.
Figure 6:
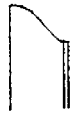
FIG. 6 is a Detail View of Section 500 of FIG. 5.

The board 33 may be rectangular, it may also be circular, oval, trapezoidal, or a variety of other shapes so long as it has an acceptable surface to mount the cap shaper. An exemplary embodiment of the board 33 is shown in FIG. 5 and is rectangular with shaped corners. The corners may be shaped decoratively as shown in FIG. 6, but may be simply squared off as well.

Figure 9:
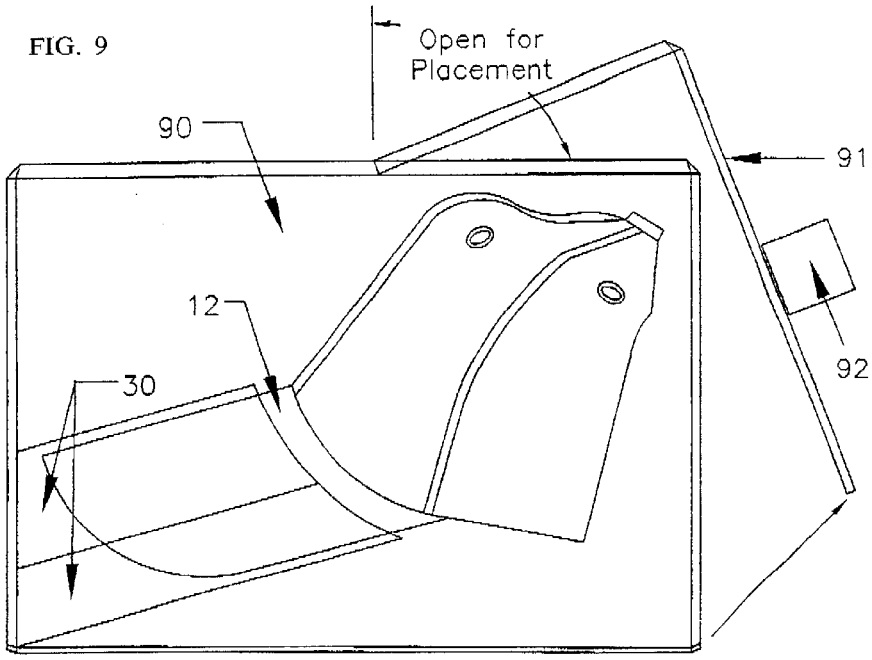
FIG. 9 is a side view of a cap shaper of the invention mounted into a carrying box.

Another exemplary embodiment of the system is illustrated in FIG. 9 wherein the support is a box 90. The box 90 is a hollow volume that may be a square, rectangular, spherical, conical, or other suitable shape. The box 90 has at least one side 91 that opens and closes and is sufficiently large to contain at least one cap brim shaper and at least one sports cap. The sides of the box 90 are either hard or soft and are either padded or unpadded. A preferred embodiment of the box is one in which the sides are strong enough to protect the cap during travel. The box may be made out of wood, plastic, metal, plexiglass, glass, cardboard, foam rubber, styrofoam, particle board, carbon composite, fabric, or other appropriate materials. The box 90 or its pieces may be created through weaving, extrusion, injection molding, casting, or woodworking or other acceptable methods.

A preferred embodiment of the system where the support is a box, is one in which any side of box 90 that opens may also be secured in a closed position. The means of securing the box in a closed position may include employing a latch, velcro, lock, button, string, zipper, or other acceptable method. An additional embodiment of a system having box 90 is one that has a carrying support 92. This carrying support may be a handle, strap, knob, or other appropriate mechanism that can be held on to.

Figure 10:
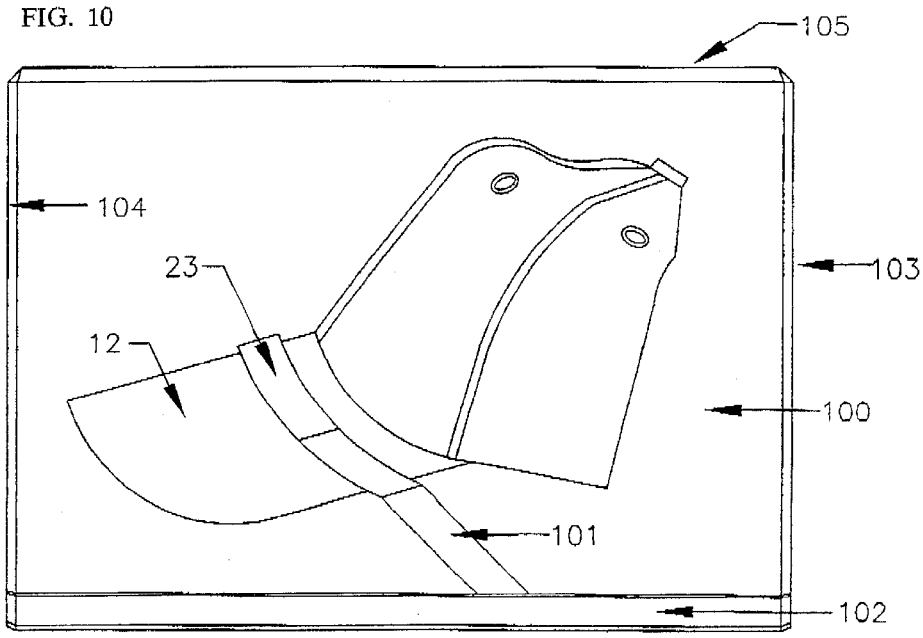
FIG. 10 is a side view of a cap shaper of the invention mounted into a display case.
Figure 11A:
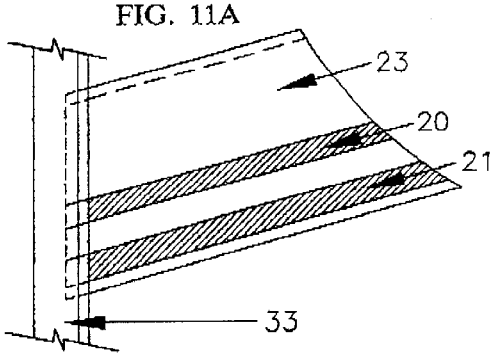
FIGS. 11A, B, C, and D are cross-section side views showing different orientations for the grooves within cap shapers of the invention.
Figure 11B:
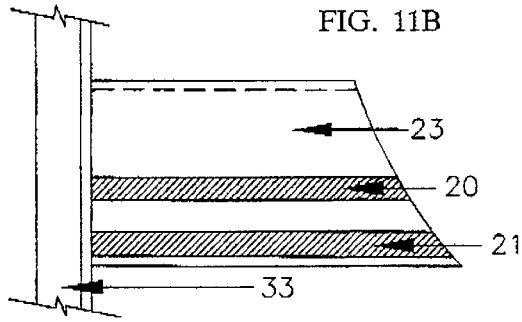
Figure 11C:
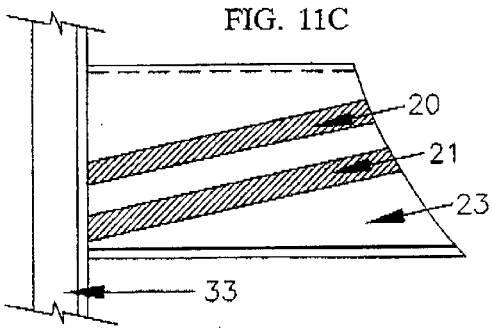
Figure 11D:
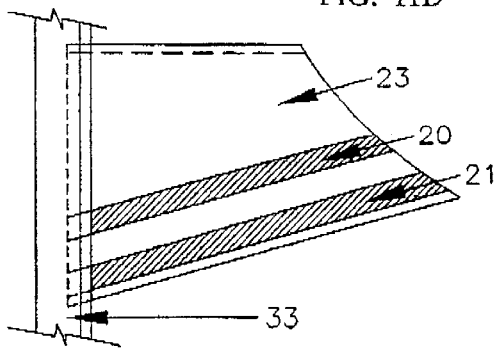

Since sports caps are commonly collected and displayed, an additional embodiment of the system may be one in which the support is a display case 100 in the form of a box with some or all transparent sides as shown in FIG. 10. The display case 100 is sufficiently large to contain at least one cap brim shaper and at least one sports cap. For example front side 104 is made transparent. One or more of the remaining sides 102, 104 and 105 may also be transparent if desired. A support in the form of board 33 is the side of the box in which the cap shaper or shapers are mounted. This board may or may not be transparent. A preferred embodiment of the transparent box display system is one which may be mounted according to the means provided for the board support 33, although it will be appreciated that the side of the display box to which the cap shaper is mounted may not be the same side of the box which is used for mounting the display case. The display case 100 may also include a stand 101 to which the cap shaper 23 of the invention is connected. The stand 101 is mounted on the bottom on a horizontal portion of the case (the bottom 102 or a shelf, not shown). The back 103 of the case 100, or some other appropriate surface is openable (for example as a hinged door) to permit access to the interior of the case 100.

Figure 12:
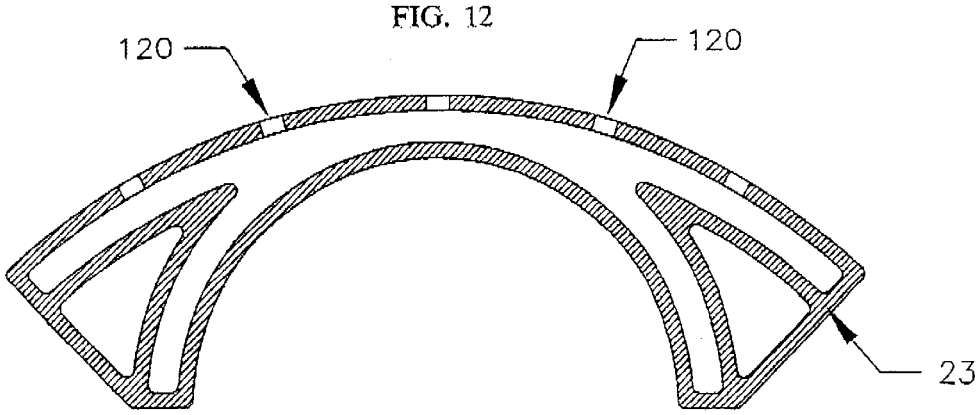
FIG. 12 shows a further embodiment of the shaper of the invention.

FIG. 12 shows a further embodiment of the cap shaper in accordance with the invention. As shown, the body member has cut-outs, holes, or slices 120 formed in at least one surface thereof, connecting the outside of the body member with the inside of the grooves in order to provide aeration to facilitate drying of a damp hat. In FIG. 12, the cutouts are formed 120 are formed in the convex surface, but they could equally be formed in the concave surface, or both. The dampness of a hat may be the result of use. It has also been found, however, that wetting or dampening the brim prior to insertion in the cap brim in the shaper of the invention can facilitate reshaping of a distorted cap brim, as well as in some cases creating a longer-lasting more stable shape.

What is claimed is:

1. A cap brim shaper comprising a body member, said body member having at least two grooves formed in a common surface thereof, including:

a first groove having a first curvature, said groove being sufficiently long and high to receive a brim of a sports cap, and a second groove having a second curvature, some part of which is greater than said first curvature, said second groove being nested within the first groove and being sufficiently long and high to receive a brim of a sports cap.

2. The cap brim shaper of claim 1, wherein the first groove has a circular curvature.

3. The cap brim shaper of claim 2, wherein the curvature of the first groove has a radius which ranges from 3 to 6 inches.

4. The cap brim shaper of claim 3, wherein the second groove has a circular curvature.

5. The cap brim shaper of claim 4, wherein the curvature of the second groove has a radius which ranges from 1⅝ to 3 inches.

6. The cap brim shaper of claim 1, wherein at least one groove is V-shaped.

7. The cap brim shaper of claim 6, wherein the at least one groove having a V-shaped curvature has a curvature at its highest point having a radius ranging between ½ to 1¼ of an inch.

8. The cap brim shaper of claim 1, wherein the body member has a third groove formed therein.

9. The cap brim shaper of claim 8, wherein the third groove has a third curvature, some part of which is greater than said second curvature, said third groove being nested within the second groove and being sufficiently long and wide to receive a brim of a sports cap.

10. The cap brim shaper of claim 8, wherein the third groove has a V-shaped curvature.

11. The cap brim shaper of claim 8, wherein at least one groove has a V-shaped curvature.

12. The cap brim shaper of claim 11, wherein the groove having a V-shaped curvature has a curvature at its highest point having a radius ranging between ½ to 1¼ of an inch.

13. The cap brim shaper of claim 1 wherein the nested grooves share a common region.

14. The cap brim shaper of claim 1 wherein the body member has openings forming channels between the exterior top, bottom and/or side surfaces of the body member and the interior of the grooves.

15. A system for holding one or more caps while shaping the brims thereof comprising;

a support; and one or more cap brim shapers comprising a body member, said body member having at least two grooves formed in a common surface thereof, including:

a first groove having a first curvature, said groove being sufficiently long and high to receive the brim of a sports cap, and a second groove having a second curvature, some part of which is greater than said first curvature, said second groove being nested with the first groove and being sufficiently long and high to receive the brim of a sports cap, said cap brim shapers being affixed to the support.

16. The system of claim 15 wherein the support is a board.

17. The system of claim 16, wherein the board is at least ¾ of an inch thick.

18. The system of claim 17, wherein the board has one or more recesses formed therein in which the one or more cap brim shapers are mounted.

19. The system of claim 16, wherein a cap brim shaper is mounted flush against the surface of the board.

20. The system of claim 16, wherein the one or more cap brim shapers are inserted at least ¼ of an inch into the board and at a sufficient angle to inhibit a cap placed into the shaper from falling out.

21. The system of claim 15, wherein the support is a box with at least one side that opens and closes and is sufficiently large to contain at least one cap brim shaper and at least one sports cap.

22. The system of claim 21, wherein any side that opens and closes, secures in a closed position.

23. The system of claim 21, wherein the box has at least one carrying support.

24. The system of claim 21, wherein the support is a display case with at least one transparent side and is sufficiently large to contain at least one cap brim shaper and at least one sports cap.

25. The system of claim 24, wherein the display case is sufficient large to contain a plurality of cap brim shaper and an equal plurality of brimmed sports caps, in a non-overlapping manner, whereby the front surface of each sports cap placed in a cap shaper can be viewed through a transparent side of the display case.

26. The cap brim shaper of claim 1, wherein the body member has a top surface, a bottom surface and a face extending from the top surface to the bottom surface and wherein the first groove and second grooves are formed in the face, as the common surface, between the top surface and the bottom surface such that a portion of the body member is present between the first and second grooves and both of the top and bottom surfaces.

* * * * *